US009975155B2

(12) United States Patent
Greenwood

(10) Patent No.: US 9,975,155 B2
(45) Date of Patent: May 22, 2018

(54) CLEANER

(75) Inventor: Kenneth John Greenwood, Queensland (AU)

(73) Assignee: NIBIRU PTY LTD, Queensland (AU)

( * ) Notice: Subject to any disclaimer, the term of this patent is extended or adjusted under 35 U.S.C. 154(b) by 683 days.

(21) Appl. No.: 13/518,315

(22) PCT Filed: Dec. 22, 2010

(86) PCT No.: PCT/AU2010/001727

§ 371 (c)(1),
(2), (4) Date: Nov. 14, 2012

(87) PCT Pub. No.: WO2011/075781

PCT Pub. Date: Jun. 30, 2011

(65) Prior Publication Data

US 2013/0174876 A1 Jul. 11, 2013

(30) Foreign Application Priority Data

Dec. 23, 2009 (AU) ..... 2009906259

(51) Int. Cl.
*B08B 9/093* (2006.01)
*B08B 9/08* (2006.01)

(52) U.S. Cl.
CPC ..... *B08B 9/093* (2013.01); *B08B 9/0813* (2013.01); *B08B 9/0936* (2013.01)

(58) Field of Classification Search
CPC .... B08B 3/02; B08B 3/04; B08B 9/08; B08B 9/0804; B08B 9/0813; B08B 9/093; B08B 9/0936
See application file for complete search history.

(56) References Cited

U.S. PATENT DOCUMENTS 3,856,570 A 12/1974 McDermott
3,916,924 A * 11/1975 McGowan ..... B05B 1/14 134/102.1
4,051,814 A * 10/1977 Jennings ..... B08B 3/026 122/448.1
4,793,734 A * 12/1988 Shook et al. ..... 404/90
4,936,330 A 6/1990 LaHue
5,377,913 A 1/1995 Van Der Woude
5,720,309 A 2/1998 Baziuk
5,720,310 A 2/1998 Moulder
(Continued)

FOREIGN PATENT DOCUMENTS

EP 1106269 A1 * 6/2001
FR 2161358 A6 * 7/1973
(Continued)

OTHER PUBLICATIONS

Machine translation: FR 2161358 A6, Monfort, Y., 1973.*
(Continued)

*Primary Examiner* — Mikhail Kornakov
*Assistant Examiner* — Natasha N Campbell
(74) *Attorney, Agent, or Firm* — Sheridan Ross, PC

(57) ABSTRACT

The invention relates to a cleaner for use in washing an internal surface of a container, the cleaner comprising an elongate boom having a head, the head having a multiplicity of nozzles in fluid communication with a pressure chamber, and at least a portion of each nozzle being angled with respect to the longitudinal axis of the head.

23 Claims, 5 Drawing Sheets

(56) References Cited

U.S. PATENT DOCUMENTS

| | | | | |
|---|---|---|---|---|
| 6,213,135 | B1 | 4/2001 | Moulder | |
| 6,640,817 | B2 * | 11/2003 | Harmon | B01F 15/00032 134/22.1 |
| 9,370,801 | B1 | 6/2016 | Short, Jr. et al. | |

FOREIGN PATENT DOCUMENTS

| | | | |
|---|---|---|---|
| JP | 01-270987 | A | 10/1989 |
| JP | 04-040252 | A | 2/1992 |
| JP | H06-193129 | | 7/1994 |
| JP | 08-144271 | A | 6/1996 |

OTHER PUBLICATIONS

International Search Report prepared by the Australian Patent Office dated Feb. 8, 2011, for International Application No. PCT/AU2010/001727.

International Preliminary Report on Patentability prepared by the Australian Patent Office dated Nov. 4, 2011, for International Application No. PCT/AU2010/001727.

* cited by examiner

CLEANER

CROSS REFERENCE TO RELATED APPLICATIONS

This application is a national stage application under 35 U.S.C. 371 of PCT Application No. PCT/AU2010/001727 having an international filing date of 22 Dec. 2010, which designated the United States, which PCT application claimed the benefit of Australian Application No. 2009906259 filed 23 Dec. 2009, the entire disclosure of each of which is incorporated herein by reference.

FIELD OF THE INVENTION

The invention relates to a cleaner. In particular, although not exclusively, the invention relates to a cleaner for cleaning a concrete truck bowl using pressurized liquid.

BACKGROUND TO THE INVENTION

Trucks for transporting pre-mixed concrete have a rotatable bowl which typically includes several internal helical fins. As the bowl rotates in one direction, the fins mix the concrete. When the bowl rotates in the other direction the fins move the concrete towards a discharge point of the bowl.

During normal operation of a concrete truck, residual concrete accumulates and hardens within the bowl, particularly in the vicinity of the fins. This residual hardened concrete reduces the capacity of the bowl, adds weight to the truck and can reduce the efficiency of the fins to mix and move the concrete.

Previous methods of removing hardened residual concrete include a worker entering the bowl and using a jackhammer to chip and break the concrete from the internal surface of the bowl and fins. This is a time consuming task which is very hazardous to the worker when in such a confined space. Additionally, there is a high potential for the internal surface and fins of the bowl to be damaged.

In order to address safety concerns, devices utilizing ultra high water pressure (up to 40,000 psi) have been used to remove hardened concrete. However, operation of these devices requires a trained operator due to safety issues surrounding the use of ultra high water pressure. Additionally, significant infrastructure is required to provide water at an ultra high pressure, which can result in high installation and running costs.

Daily washing of the bowl to remove concrete before it is cured can reduce the build up of concrete within the bowl. Previous methods of daily washing include loading a large amount of water into the bowl, rotating the bowl and then discharging the water. This method uses a large volume of water, and often does not remove concrete which has begun to cure. In particular, concrete located adjacent the fins is difficult to remove by this method.

The use of chemical agents in wash water has been postulated to assist in the removal of concrete residue. However, the use of these agents can contaminate later batches of concrete and also prevents the recycling of the wash water back into a concrete plant.

OBJECT OF THE INVENTION

It is an object of the invention to overcome or at least alleviate one or more of the above problems and/or provide the consumer with a useful or commercial choice.

DISCLOSURE OF THE INVENTION

In one form, although it need not be the only or indeed the broadest form, the invention resides in a cleaner for use in washing an internal surface of a container, the cleaner comprising:

an elongate boom having a head;

the head having a multiplicity of nozzles in fluid communication with a pressure chamber, at least a portion of each nozzle being angled with respect to a longitudinal axis of the head.

Preferably the cleaner also includes a rotator to oscillate or rotate the head.

The cleaner preferably also includes a pump to supply water to the head.

A support is typically used to mount the boom. Normally, the boom can move between an extended position and a retracted position with respect to the support.

A stand is preferably utilized to mount the support. In one embodiment the height of the stand is adjustable.

Preferably there are at least four nozzles equally spaced around the pressure chamber. More preferably there are six nozzles equally spaced around the pressure chamber. Suitably, each nozzle has a nozzle end through which water exits. The nozzle ends are arranged in a helical manner around the pressure chamber.

Preferably the angled portion of each nozzle is angled at about 60-85° with respect to the longitudinal axis of the head. In a particularly preferred embodiment the angled portion of each nozzle is angled at about 75° with respect to the longitudinal axis of the head.

Preferably the length of each nozzle is at least ten times the length of an internal diameter of the nozzle end. It is particularly preferred that the length of each nozzle is at least fourteen times the length of an internal diameter of the nozzle end.

Preferably the rotator oscillates the head through an angle of between 80-120°. Oscillation through an angle of 90° is particularly preferred. Alternatively the rotator oscillates the head through 360°.

The cleaner may further comprise a washdown hose in fluid communication with the pump, for use in washing an external surface of the container.

In another form, the invention resides in a method of cleaning a container including the steps of:

moving an elongate boom having a boom body and a head until at least the head is located within the container;

passing water through a multiplicity of nozzles forming part of the head wherein a least a portion of each nozzle is angled with respect to a longitudinal axis of the head;

pumping water through each nozzle, such that the water exits each nozzle as a substantially laminar flow; and oscillating the head.

Suitably the water is pumped at a pressure of less than 500 psi. Preferably the pressure is between 150-500 psi. More preferably the pressure is between 200-350 psi. The water pressure may be selected from 200, 225, 250, 275, 300, 325, or 350 psi.

Suitably the pump supplies water at a rate of between 300-600 L/min. Preferably, the pump supplies water at a rate of between 400-500 L/min. The supply rate of the water may be selected from 400, 425, 450, 475 and 500 L/min.

The method may further comprise the step of pumping water through a washdown hose to clean an external surface of the container.

In another form, the invention resides in a head for a cleaner, the head comprising:

a pressure chamber to receive a fluid;

a multiplicity of nozzles in fluid communication with the pressure chamber, wherein at least a portion of each nozzle is angled with respect to a longitudinal axis of the head.

Preferably the angled portion of each nozzle is angled at about 60-85° with respect to the longitudinal axis of the head. In a particularly preferred embodiment the angled portion of each nozzle is angled at about 75° with respect to the longitudinal axis of the head.

Preferably the length of each nozzle is at least ten times the length of an internal diameter of the nozzle end. It is particularly preferred that the length of each nozzle is at least fourteen times the length of an internal diameter of the nozzle end. Suitably the head further comprises a locating sleeve to support the angled portion of each nozzle.

In one embodiment the head further comprises at least one guard rail to protect the nozzles.

Further features of the present invention will become apparent from the following detailed description.

BRIEF DESCRIPTION OF THE DRAWINGS

To assist in understanding the invention and to enable a person skilled in the art to put the invention into practical effect preferred embodiments of the invention will be described by way of example only with reference to the accompanying drawings, wherein.

DETAILED DESCRIPTION OF THE INVENTION

A cleaner for washing the interior of a container has been developed. To assist with understanding of the invention a number of specific embodiments will be described with particular reference to washing concrete from the bowl of a concrete truck. It is anticipated that the invention will have particular application to washing concrete truck bowls due to the characteristics of the apparatus. Nonetheless, the invention is not limited only to washing concrete truck bowls.

Figures 1, 1A:
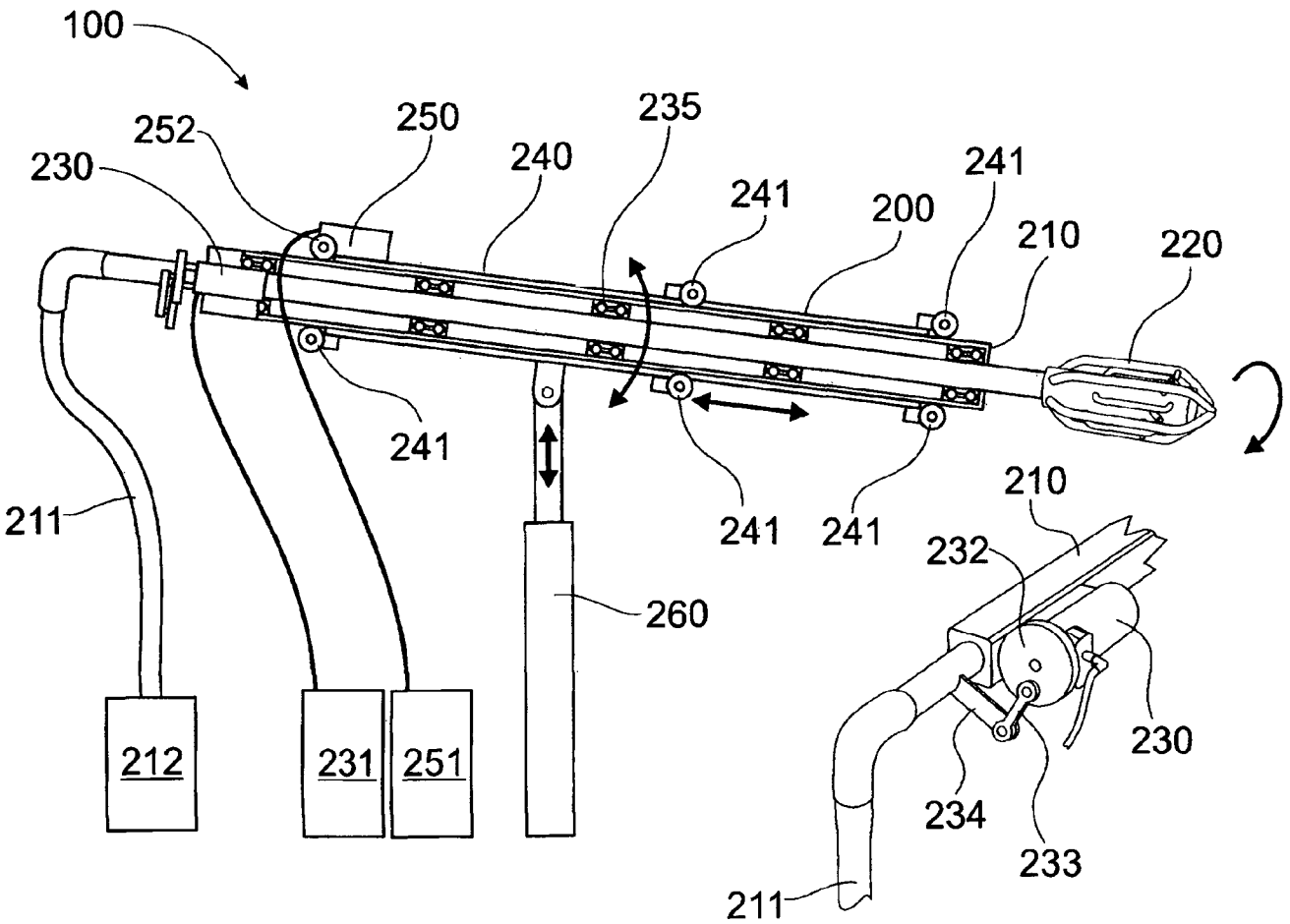
FIG. 1 shows a schematic of a cleaner according to one embodiment of the invention.

The cleaner 100 includes a boom 200 having a boom body 210, a head 220, a rotator 230, and a support 240. A schematic of an embodiment of the cleaner 100 is shown in FIG. 1.

The boom body 210 is in the form of an elongate hollow rectangular prism. A hose 211 extends through the boom body 210. Alternatively, the hose 211 may be secured to the exterior of the boom body 210. In a further alternative, the hose 211 connects to an end of the boom body 210 such that water passes through the boom body 210 itself.

A water delivery system 212 is connected to the hose 211 and includes a pump (not shown) for pumping water through the hose 211. The pump is an oil assisted diaphragm pump, which allows the use of recycled water. However, it should be appreciated that other types of pump may be used.

The rotator 230 is attached to an end of the boom body 210. The rotator 230 acts to oscillate the hose 211, which is located within the boom body 210, through a rotation of between 80-120° around the longitudinal axis of the hose 211. Oscillation through an angle of 90° is particularly suitable although alternatively the rotator 230 oscillates the hose 211 through any angle up to and including 360°.

Bearings 235 are located between the boom body 210 and the hose 211 to reduce friction between the boom body 210 and the hose 211 when the hose 211 is rotated.

Alternatively, the hose 211 is fixed with respect to the boom body 210 and the boom body 210 is rotated by the rotator 230.

As shown in FIG. 1A, the rotator 230 includes a disc 232 which is attached by a rod 233 to a rigid member 234. The rigid member 234 is in contact with the hose 211. The disc 232 rotates which moves the rod 233 which in turn transfers the motion to the rigid member 234. The movement of the rigid member 234 then rotates the hose 211 by frictional engagement. Alternatively, other methods of providing an oscillation may be utilized, such as a belt which transfers rotational motion of the disc 232 to the hose 211. The rotator 230 is powered by a rotation motor 231.

The support 240 supports the boom body 210. The support 240 is in the form of a sleeve which surrounds a portion of the boom body 210. Alternatively, the support 240 is in the form of a track which supports the boom body 210.

A series of bearings 241 (in the form of wheels) are located between the support 240 and the boom body 210 to provide movement of the boom body 210 between an extended and a retracted position.

A boom movement actuator 250 is mounted on the support 240 to reciprocate movement of the boom body 210 along the bearings 241 within the support 240. The boom movement actuator 250 includes a driven wheel 252, which contacts the boom body 210. As the driven wheel 252 is rotated, the driven wheel 252 causes the boom body 210 to move by frictional engagement between an extended and retracted position with respect to the support 240.

Alternatively, the boom movement actuator 250 may be in the form of a rack and pinion movement mechanism, where a rack is located along the boom body 210 and the boom movement actuator 250 is a circular pinion. In order to move the boom body 210, the pinion is rotated causing the rack to move in a linear manner.

The boom movement actuator 250 is powered by a boom movement motor 251. The boom movement motor 251 may be the same as the oscillation motor 231.

A stand 260 is used to hold the support 240. The stand 260 is height adjustable by a manually operated mechanism, a hydraulic system or an electronically controlled motor. The support 240 is pivotally connected to the stand 260. Pivotal movement of the support 240 may be manually operated or electronically controlled.

The head 220 is in fluid connection with the hose 211. The head 220 has a threaded end 223 to enable the head 220 to be screwed onto a correspondingly threaded end of the hose 211. Alternatively, clips, welds, bolts or other substantially water-tight connections may be utilized. The connection may also include seals to reduce water leakage at the connection. The connection is such that the action of the rotator 230 to oscillate the hose 211 similarly rotates the head 220.

Figure 2:
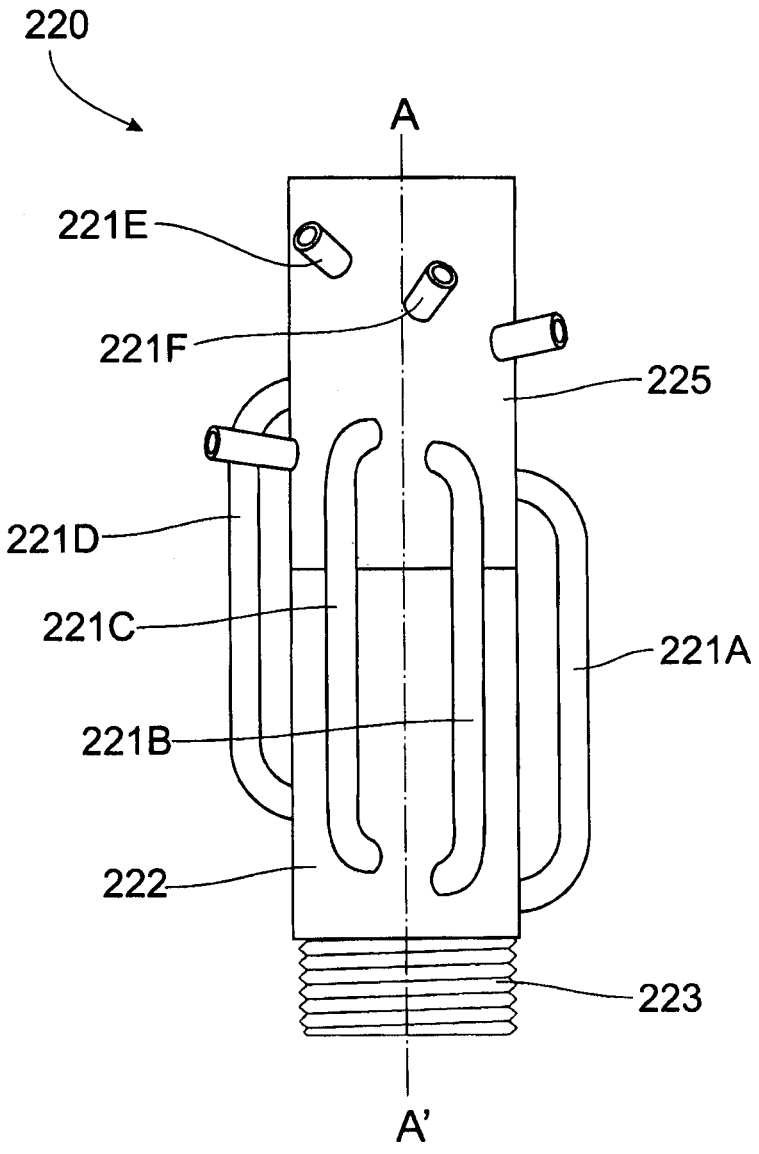
FIG. 2 shows an embodiment of a head of the cleaner.

The head 220 includes six nozzles 221A-F and a pressure chamber 222, as shown in FIG. 2. Alternatively, more or fewer nozzles may be included on the head 220. The pressure chamber 222 is suitable cylindrical, although other shapes may be utilized.

Figure 3:
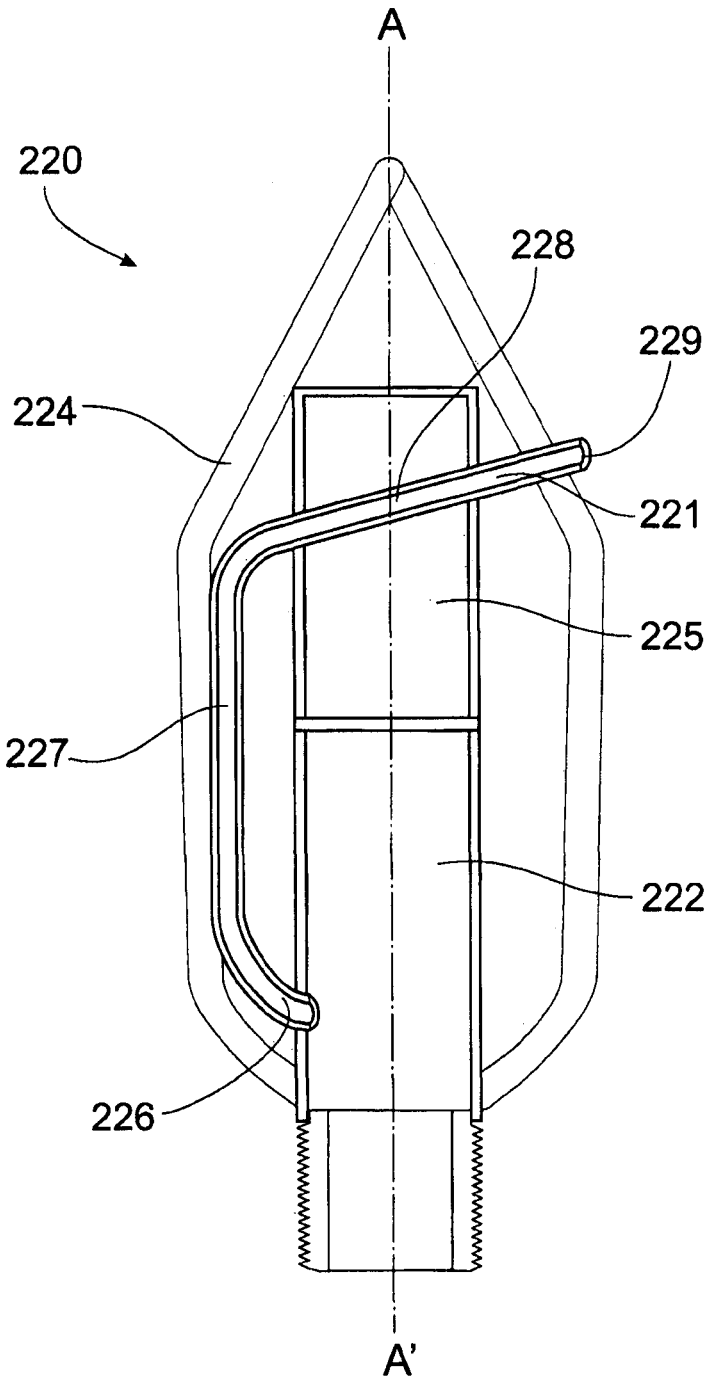
FIG. 3 shows a schematic of sectional view of the head of FIG. 2 including one nozzle.

FIG. 3 shows a detailed view in cross section of the head 220 and one nozzle 221A. Each nozzle 221A-F is of substantially the same shape as nozzle 221A. Nozzle 221A is in the form of an elongate tube of three portions. The length of each nozzle 221A is at least fourteen times the internal diameter of the tube to assist in the reduction in turbulence of water passing through the nozzle 221A. Alternatively, the length of the nozzle 221A-F should be at least ten or twelve times the internal diameter of the tube.

A first portion 226 of the nozzle 221A is in fluid communication with the pressure chamber 222. The nozzle 221A includes a second portion 227 which is disposed parallel to a longitudinal axis A-A' of the head 220. A third portion 228 of the nozzle 221A is disposed at an angle with respect to the longitudinal axis A-A'. In a preferred embodiment the angle between the nozzle 221A and the longitudinal axis A-A' is approximately 60-85°.

The third portion 228 of the nozzles 221A-F ends with a nozzle end 229A-F where water exits the nozzle 221A. The nozzle ends 229A-F are suitably arranged in a helical fashion around the pressure chamber 222 such that water exiting the head 220 is directed substantially 360° around the head 220.

The head 220 also includes a locating sleeve 225, which is in the form of a hollow cylinder. The third portion 228 of each nozzle 221A-F passes through the locating sleeve 225 and is thus supported and protected by the locating sleeve 225. By locating the third portion 228 of each nozzle 221A-F through the locating sleeve 225, a relatively compact head 220 is achieved.

One or more guard rails 224 are fitted to the head 220 to protect the nozzles 221A-F from damage during use. The guard rails 224 are shaped to form a cage around the head 220 and nozzles 221A-F.

Figure 4:
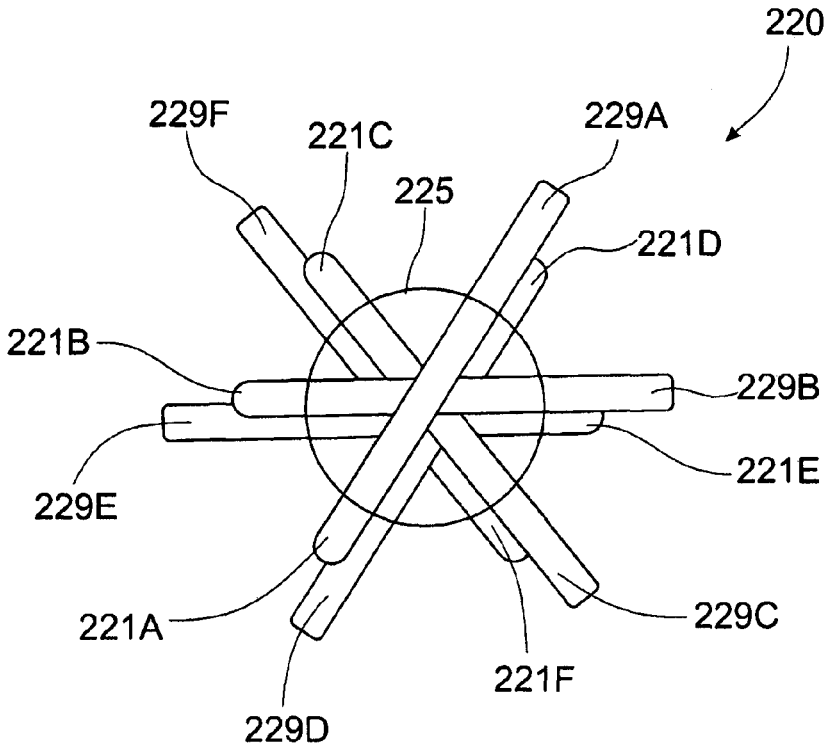
FIG. 4 shows a schematic of a latitudinal sectional view through the head of FIG. 2.

FIG. 4 shows a cross-sectional view through the head 220, when six nozzles 221A-F are present. The third portions 228A-F of each nozzle 221A-F can be seen passing through the locating sleeve 225, ending with nozzle ends 229A-F.

In operation, a concrete truck reverses to a predetermined position in front of the cleaner 100. An operator adjusts the height of the boom 200 by adjusting the height of the stand 260, and also adjusts the angle of the support 240 until the boom 200 is substantially aligned with a central axis of the bowl of the concrete truck. The boom movement actuator 250 is activated to move the boom body 210 along the support 240 such that boom body 210 is extended and the head 220 enters the bowl of the concrete truck.

Once the head 220 of the boom 200 has been fully extended into the bowl, water is pumped by the water delivery system 212 through the hose 211 to the head 220. Water fills the pressure chamber 222 of the head 220, and subsequently passes into the nozzles 221A-F. The water exits each nozzle 221A-F via nozzle ends 229A-F as a water stream with a substantially laminar flow.

Whilst water is being pumped through the cleaner 100, the hose 211 is oscillated by the rotator 230. Oscillation of the hose 211 results in a varied impingement of the water stream onto the interior of the bowl. The water stream rebounds within the interior of the bowl in an erratic manner, which provides a further washing effect. The bowl of the concrete truck remains stationary during the washing operation.

The boom 200 is then retracted whilst washing the interior of the bowl. Alternatively, washing of the interior of the bowl may occur whilst the boom 200 is being extended into the bowl as well as during the retraction of the boom 200. The residual concrete is washed from surfaces within the bowl, creating dilute concrete slurry within the bowl. The water is pumped at a water pressure of less than 500 psi. Alternatively, the water may be pumped at a water pressure of 200-350 psi.

The rate of water pumped is 300-600 L/min, although a supply rate of between 400-500 L/min is preferred. The washing cycle time for a standard size concrete truck is suitably less than five minutes, and in a preferred embodiment is 1-2 minutes.

After the boom 200 has been retracted from the bowl, the concrete truck may be emptied of the dilute concrete slurry into a waste or water recycling area.

Figure 5:
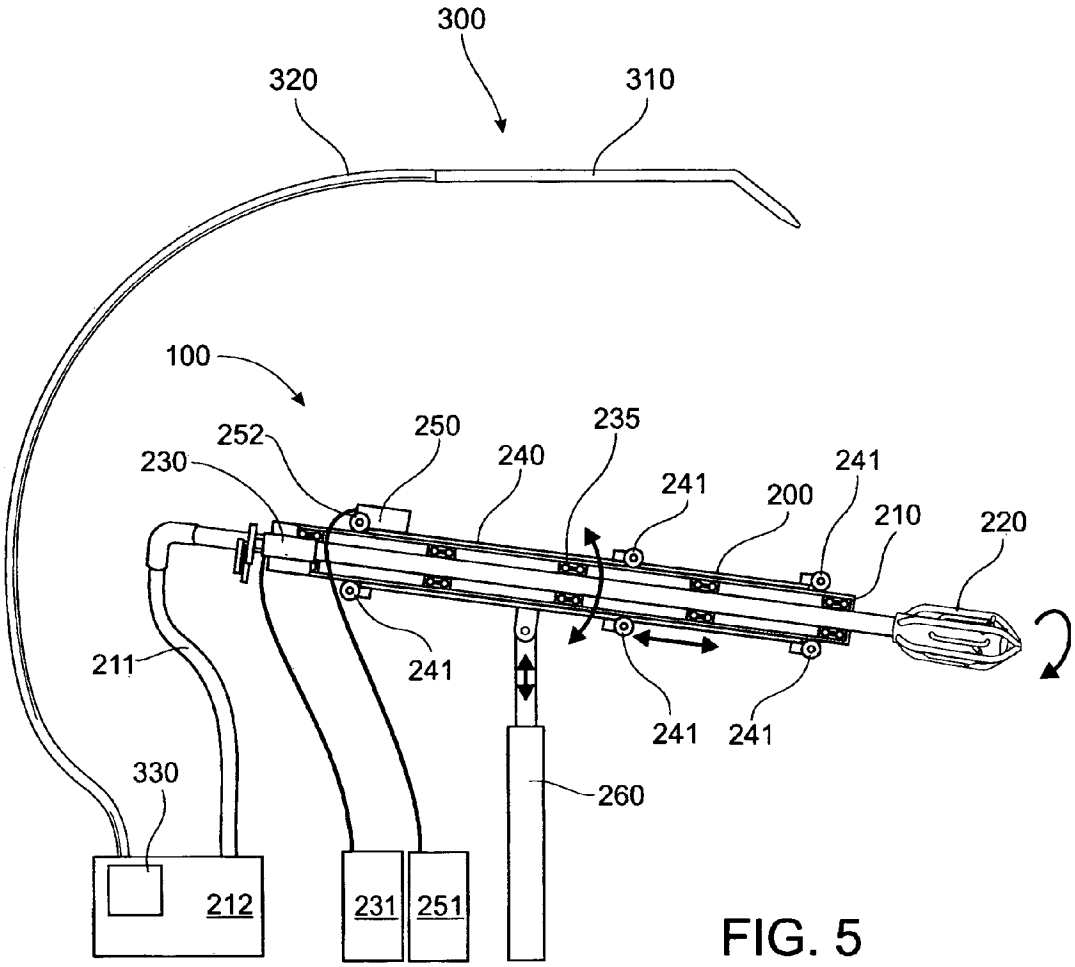
FIG. 5 shows a schematic of a cleaner according to a second embodiment of the invention.

FIG. 5 shows a second embodiment of the cleaner 100. A washdown wand 300 having a washdown wand nozzle 310 is connected to the water delivery system 212 via a washdown wand hose 320. The washdown wand nozzle 310 is designed to be held by a person, and includes a handle or a gripping area.

A washdown wand switch 330 controls the supply of water from the water delivery system 212 to the washdown wand 300. The washdown wand switch 330 is incorporated to the water delivery system 212, or alternatively the washdown wand switch 330 is location on the washdown wand 300. The washdown wand switch 330 includes an automatic switch to transfer the water supply from the boom 200 to the washdown wand 300 once operation of the boom 200 is completed.

The washdown wand switch 330 may incorporate a timer, such that water is only supplied to the washdown wand 300 for between 5 and 15 minutes. Preferably the washdown wand 300 may only be operated for 10 minutes. Water supply to the washdown wand 300 may be shut off earlier by operation of a washdown override switch incorporated into the washdown wand switch 330.

In use, once the boom 200 has been retracted from the bowl the water delivery system 212 automatically switches the water supply from the boom 200 to the washdown wand 300. Alternatively, the washdown wand switch 330 may be manually operated to supply water to the washdown wand 300.

Water from the washdown wand 300 may be used to clean the exit chute of the bowl and/or the exterior surfaces of the bowl and concrete truck. The water pressure from the water delivery system 212 to the washdown wand 300 is similar to that delivered to the boom 200. The rate of water pumped through the washdown wand 300 is between 20 to 50% to the rate of water pumped to the boom 200.

Water which has been recycled in the concrete plant may be utilized in the cleaner 100, in order to reduce the total water usage of the concrete plant.

It is believed that the arrangement of the nozzles 221A-F and in particular the length of the nozzles 221A-F being at least fourteen times the internal diameter of the nozzles 221A-F reduces atomization and fanning of the water stream leaving the nozzles 221A-F. Accordingly, the water stream leaving the nozzles 221A-F has a substantially laminar flow which creates a high impact water stream. The high impact water stream efficiently washes residual concrete from the interior of the bowl including the fins without the need for ultra high water pressures.

Oscillation of the boom 200, together with the use of multiple nozzles 221A-F, provides a high impact water stream which is directed onto virtually all surfaces inside the bowl of the concrete truck. Whilst the cleaner 100 does not remove cured and hardened concrete, use in-between loads or on a daily basis can assist in the prevention of the build up of residual concrete.

The cleaner 100 does not require the use of large quantities of water, chemical agents or ultra high pressure water. Thus the operation of the cleaner 100 can be undertaken by an operator, such as the driver of the concrete truck, with only minimal training. The use of only water during the washing operation results in a dilute concrete slurry which can be recycled into a water recycling system, which are in common usage at concrete plants.

As it is not necessary to rotate the bowl of the concrete truck during operation of the cleaner 100, the risk of damage to either the interior of the bowl, the fins or the head 220 of the cleaner 100 may be reduced.

Additionally, the cleaner 100 is compact and may be used without first removing the delivery chute of the concrete truck. Thus the time to undertake a washing operation is greatly reduced when compared to prior art methods.

Throughout the specification the aim has been to describe the invention without limiting the invention to any one embodiment or specific collection of features. Persons skilled in the relevant art may realize variations from the specific embodiments that will nonetheless fall within the scope of the invention. For example, the boom body may be constructed so that it can move in a telescopic fashion to extend the head into the bowl of a concrete truck.

It will be appreciated that various other changes and modifications may be made to the embodiment described without departing from the spirit and scope of the invention.

The invention claimed is:

1. A cleaner for use in washing an internal surface of a container, the cleaner comprising:

an elongate boom having a head;

the head having a pressure chamber, a locating sleeve, and a multiplicity of nozzles in fluid communication with the pressure chamber, wherein at least a portion of each nozzle is angled with respect to a longitudinal axis of the head and the angled portion of each nozzle extends through the locating sleeve to support each nozzle;

wherein the length of each nozzle is at least ten times an internal diameter of a nozzle end and creates a substantially laminar flow in fluid passing through.

2. The cleaner of claim 1, further comprising a rotator to oscillate or rotate the head.

3. The cleaner of claim 1 wherein the angle between the angled portion of each nozzle and the longitudinal axis of the head is between 60-85°.

4. The cleaner of claim 1 wherein the angle between the angled portion of each nozzle and the longitudinal axis of the head is 75°.

5. The cleaner of claim 1, further comprising a pump to supply water to the head.

6. The cleaner of claim 5, wherein the pump comprises an oil assisted diaphragm pump.

7. The cleaner of claim 1, wherein a support is used to mount the elongate boom.

8. The cleaner of claim 7, wherein the elongate boom is moveable between an extended position and a retracted position with respect to the support.

9. The cleaner of claim 7, wherein a stand is used to mount the support.

10. The cleaner of claim 9, wherein the height of the stand is adjustable.

11. The cleaner of claim 1, wherein each nozzle has a nozzle end through which water exits, the nozzle ends being arranged in a helical manner around the pressure chamber.

12. The cleaner of claim 1, wherein the length of each nozzle is at least fourteen times the length of the internal diameter of the nozzle end.

13. The cleaner of claim 1, wherein each nozzle comprises three portions; a first portion in fluid communication with the pressure chamber, a second portion disposed parallel to the longitudinal axis of the head, and a third portion disposed at an angle with respect to the longitudinal axis.

14. The cleaner of claim 1, wherein a portion of each nozzle passes through the longitudinal axis of the head.

15. The cleaner of claim 1, wherein the pressure chamber is cylindrical.

16. The cleaner of claim 1, wherein each nozzle has an orifice with a circular cross section.

17. A method of cleaning a container including the steps of:

moving an elongate boom having a boom body and a head until at least the head is located within the container;

passing water through a pressure chamber and a multiplicity of nozzles forming part of the head, wherein the length of each nozzle is at least ten times an internal diameter of a nozzle and at least a portion of each nozzle is angled with respect to a longitudinal axis of the head, wherein the angled portion of each nozzle extends through a locating sleeve of the head to support each nozzle;

pumping water through each nozzle, such that the water exits each nozzle as a substantially laminar flow; and oscillating or rotating the head.

18. The method of claim 17, wherein the container is a concrete truck bowl and the step of moving an elongate boom until at least the head is located within the container comprises:

adjusting the height of the boom until the boom is substantially aligned with a central axis of the concrete truck bowl; and extending the boom body such that the head of the elongate boom enters the bowl of the concrete truck.

19. A head for a cleaner, the head comprising:

a pressure chamber to receive a fluid;

a multiplicity of nozzles in fluid communication with the pressure chamber, wherein at least a portion of each nozzle is angled with respect to a longitudinal axis of the head; and a locating sleeve, wherein the angled portion of each nozzle extends through the locating sleeve to support each nozzle;

wherein the length of each nozzle is at least ten times an internal diameter of a nozzle end and creates a substantially laminar flow in fluid passing through.

20. The head of claim 19, wherein the length of each nozzle is at least fourteen times the length of the internal diameter of the nozzle end.

21. The head of claim 19, further comprising at least one guard rail to protect the nozzles.

22. The head of claim 19, wherein the angle between the angled portion of each nozzle and the longitudinal axis of the head is between 60-85°.

23. The head of claim 19, wherein the angle between the angled portion of each nozzle and the longitudinal axis of the head is 75°.

* * * * *